US008867955B2

(12) United States Patent
Yamaguchi et al.

(10) Patent No.: US 8,867,955 B2
(45) Date of Patent: Oct. 21, 2014

(54) DEVELOPER ACCOMMODATING UNIT, PROCESS CARTRIDGE AND ELECTROPHOTOGRAPHIC IMAGE FORMING APPARATUS

(71) Applicant: Canon Kabushiki Kaisha, Tokyo (JP)

(72) Inventors: Koji Yamaguchi, Numazu (JP); Hiroomi Matsuzaki, Mishima (JP); Masaakii Matsushita, Yokohama (JP); Junichi Matsumura, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 16 days.

(21) Appl. No.: 13/679,165

(22) Filed: Nov. 16, 2012

(65) Prior Publication Data

US 2013/0136489 A1 May 30, 2013

(30) Foreign Application Priority Data

Nov. 29, 2011 (JP) ..... 2011-260187

(51) Int. Cl.
*G03G 15/08* (2006.01)

(52) U.S. Cl.
CPC .... *G03G 15/0881* (2013.01); *G03G 2215/0687* (2013.01); *G03G 15/0882* (2013.01)
USPC ..... 399/106

(58) Field of Classification Search
CPC ..... G03G 15/0881; G03G 15/0882; G03G 15/0886; G03G 2215/0687; G03G 2215/0877; G03G 2215/088
USPC ..... 399/106, 103
See application file for complete search history.

(56) References Cited

U.S. PATENT DOCUMENTS 5,742,877 A 4/1998 Okada et al.
5,778,282 A 7/1998 Nagashima
5,943,529 A 8/1999 Miyabe et al.

(Continued)

FOREIGN PATENT DOCUMENTS

CN 1086612 A 5/1994
CN 1116325 A 2/1996

(Continued)

OTHER PUBLICATIONS

Office Action in Chinese Patent Application No. 201210485238.9, dated May 5, 2014 (with English translation).

(Continued)

*Primary Examiner* — Sophia S Chen
(74) *Attorney, Agent, or Firm* — Fitzpatrick, Cella, Harper & Scinto

(57) ABSTRACT

A developer accommodating unit includes a flexible developer accommodating container sealed with a sealing member at its developer discharging opening; a rotatable unsealing member for removing the sealing member from the opening; a drive transmission member for transmitting a rotational force to the unsealing member, wherein the drive transmission member is mounted at one longitudinal end portion of the unsealing member and is rotatably assembled with a frame; and a supporting member for supporting the unsealing member when the unsealing member is assembled. The supporting member includes a preventing portion for preventing the unsealing member from dropping from the supporting member. In a state in which the drive transmission member is assembled with the frame, a gap between the unsealing member and the supporting member is larger than a gap between the drive transmission member and the frame. The unsealing member is spaced from the supporting member.

7 Claims, 9 Drawing Sheets

(56) References Cited

U.S. PATENT DOCUMENTS

| | | | | |
|---|---|---|---|---|
| 5,966,567 | A | | 10/1999 | Matsuzaki et al. |
| 6,011,941 | A | | 1/2000 | Takashima et al. |
| 6,097,906 | A | | 8/2000 | Matsuzaki et al. |
| 6,118,958 | A | | 9/2000 | Nagashima |
| 6,122,458 | A | * | 9/2000 | Kita et al. |
| 6,144,815 | A | | 11/2000 | Chadani et al. |
| 6,173,140 | B1 | | 1/2001 | Suzuki et al. |
| 6,173,145 | B1 | | 1/2001 | Chadani et al. |
| 6,205,305 | B1 | | 3/2001 | Suzuki et al. |
| 6,219,504 | B1 | | 4/2001 | Matsuzaki et al. |
| 6,282,389 | B1 | | 8/2001 | Matsuzaki et al. |
| 6,405,004 | B2 | | 6/2002 | Matsuzaki et al. |
| 6,549,736 | B2 | | 4/2003 | Miyabe et al. |
| 6,681,088 | B2 | | 1/2004 | Kanno et al. |
| 6,782,219 | B2 | | 8/2004 | Yoshino et al. |
| 6,792,229 | B2 | | 9/2004 | Matsuzaki |
| 6,795,666 | B2 | | 9/2004 | Miyabe et al. |
| 6,834,173 | B2 | | 12/2004 | Yamaguchi et al. |
| 6,915,092 | B2 | | 7/2005 | Yamaguchi et al. |
| 6,931,226 | B2 | | 8/2005 | Chadani et al. |
| 6,934,485 | B2 | | 8/2005 | Miyabe et al. |
| 6,947,687 | B2 | | 9/2005 | Yamaguchi et al. |
| 6,961,528 | B2 | | 11/2005 | Yamaguchi et al. |
| 6,983,115 | B2 | | 1/2006 | Isobe et al. |
| 7,068,965 | B2 | | 6/2006 | Yoshino et al. |
| 7,116,925 | B2 | | 10/2006 | Yamaguchi |
| 7,136,604 | B2 | | 11/2006 | Chadani et al. |
| 7,184,687 | B2 | | 2/2007 | Yamaguchi et al. |
| 7,194,225 | B2 | | 3/2007 | Yamaguchi |
| 7,224,925 | B2 | | 5/2007 | Sato et al. |
| 7,319,834 | B2 | | 1/2008 | Yamaguchi |
| 7,349,657 | B2 | | 3/2008 | Sato et al. |
| 7,412,193 | B2 | | 8/2008 | Sato et al. |
| 7,477,865 | B2 | | 1/2009 | Yamaguchi |
| 7,519,310 | B2 | | 4/2009 | Yamaguchi et al. |
| 7,792,460 | B2 | | 9/2010 | Yamaguchi et al. |
| 8,121,519 | B2 | | 2/2012 | Yamaguchi et al. |
| 2002/0018668 | A1 | * | 2/2002 | Kanno et al. ..... 399/106 |
| 2009/0297207 | A1 | * | 12/2009 | Furukawa et al. ..... 399/106 |
| 2011/0142487 | A1 | | 6/2011 | Anan et al. |
| 2011/0170906 | A1 | | 7/2011 | Matsushita et al. |
| 2012/0027457 | A1 | | 2/2012 | Yamaguchi et al. |

FOREIGN PATENT DOCUMENTS

| | | | |
|---|---|---|---|
| EP | 1 168 100 | A1 | 1/2002 |
| JP | 4-66980 | | 3/1992 |
| JP | 05-232808 | A | 9/1993 |
| JP | 8-248752 | | 9/1996 |
| JP | 2000-155458 | A | 6/2000 |
| JP | 3920901 | B2 | 7/2006 |

OTHER PUBLICATIONS

Search Report in European Patent Application No. 12191365.1, dated Jun. 2, 2014.

* cited by examiner (a)

(b)

DEVELOPER ACCOMMODATING UNIT, PROCESS CARTRIDGE AND ELECTROPHOTOGRAPHIC IMAGE FORMING APPARATUS

FIELD OF THE INVENTION AND RELATED ART

The present invention relates to a developer accommodating unit, a process cartridge using the developer accommodating unit and an image forming apparatus using the process cartridge.

The image forming apparatus forms an image on a recording material (medium) by using, e.g., an electrophotographic image forming process and may include, e.g., an electrophotographic copying machine, an electrophotographic printer (such as an LED printer or a laser beam printer), an electrophotographic facsimile machine and the like.

Further, the process cartridge is prepared by integrally assembling a photosensitive member and process means, such as a developing means, acting on the photosensitive member into a cartridge, which is detachably mountable to a main assembly of the electrophotographic image forming apparatus.

Further, the developer accommodating unit at least includes a flexibility container for accommodating a developer.

In a conventional electrophotographic image forming apparatus using the electrophotographic image forming process, a process cartridge type in which an electrophotographic photosensitive member and process means acting on the photosensitive member are integrally assembled into a cartridge and this cartridge is detachably mountable to a main assembly of the electrophotographic image forming apparatus is employed.

In such a process cartridge, as shown in FIG. 10, an opening provided to a developer accommodating container 100 for accommodating a developer (toner, carrier, etc.) is sealed with a sealing member 101 constituted by a seal member or the like. A type in which a bonding portion 102 of the sealing member 101 is pulled off when used and thus the opening is unsealed (opened) to permit feeding of the developer has been widely used (Japanese Laid-Open Patent Application (JP-A) Hei 4-66980, FIG. 11).

Further, a process cartridge in which the developer accommodating container 100 is made deformable in order to solve a problem that the developer is scattered in the process cartridge in a developer filling step during manufacturing of the process cartridge has been devised (JP-A Hei 4-66980, FIG. 12).

For the above-described developer accommodating container, it would be considered that the sealing member 101 is automatically wound up in the image forming apparatus to permit unsealing. However, for that purpose, there is a need to incorporate, into the image forming apparatus, a mechanism for winding up the sealing member, but in recent years, downsizing of the cartridge is desired and therefore it is not easy to incorporate a driving shaft or the like with high accuracy.

SUMMARY OF THE INVENTION

The present invention has been accomplished in view of the above-described circumstances. A principal object of the present invention is, when a mechanism for winding up and unsealing a sealing member for a developer accommodating container is incorporated, to facilitate assembling of associated members and to enable the assembling with high accuracy.

According to an aspect of the present invention, there is provided a developer accommodating unit for accommodating a developer, comprising: a flexible developer accommodating container which accommodates the developer and is sealed with a sealing member at its opening for permitting discharge of the developer; a rotatable unsealing member for removing the sealing member from the opening; a drive transmission member for transmitting a rotational force to the unsealing member, wherein the drive transmission member is mounted at one of longitudinal end portions of the unsealing member and is rotatably assembled with a frame; and a supporting member for supporting the unsealing member when the unsealing member is assembled, wherein the supporting member includes a preventing portion for preventing the unsealing member from dropping from the supporting member in a state before the drive transmission member is assembled with the frame, and wherein in a state in which the drive transmission member is assembled with the frame, a gap between the unsealing member and the supporting member is larger than a gap between the drive transmission member and the frame, and the unsealing member is spaced from the supporting member.

These and other objects, features and advantages of the present invention will become more apparent upon a consideration of the following description of the preferred embodiments of the present invention taken in conjunction with the accompanying drawings.

Figure 6:
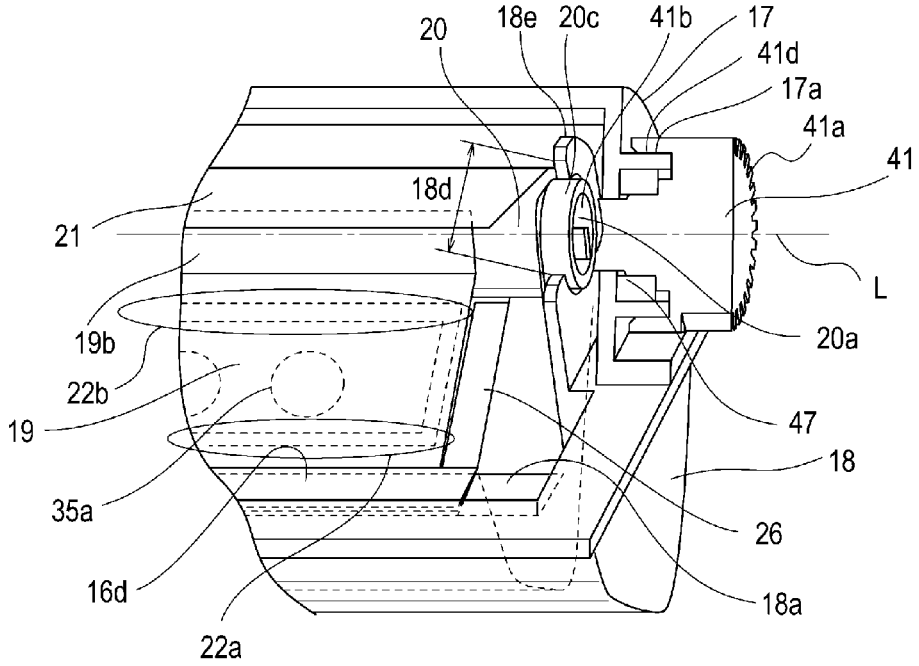
Figure 6:
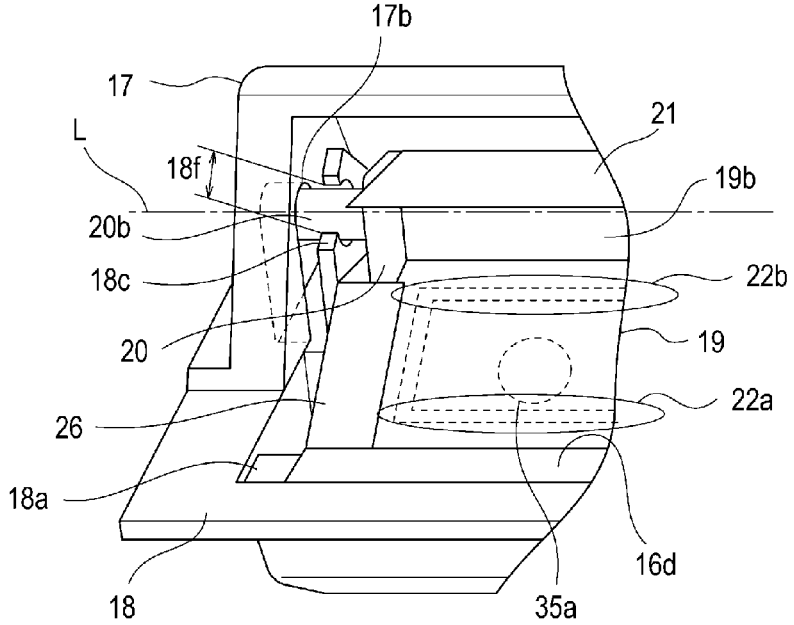

Parts (a) and (b) of FIG. 6 are perspective sectional views of the developer accommodating unit in the embodiment of the present invention, wherein (a) shows a driving side and (b) shows a non-driving side.

Figure 7:
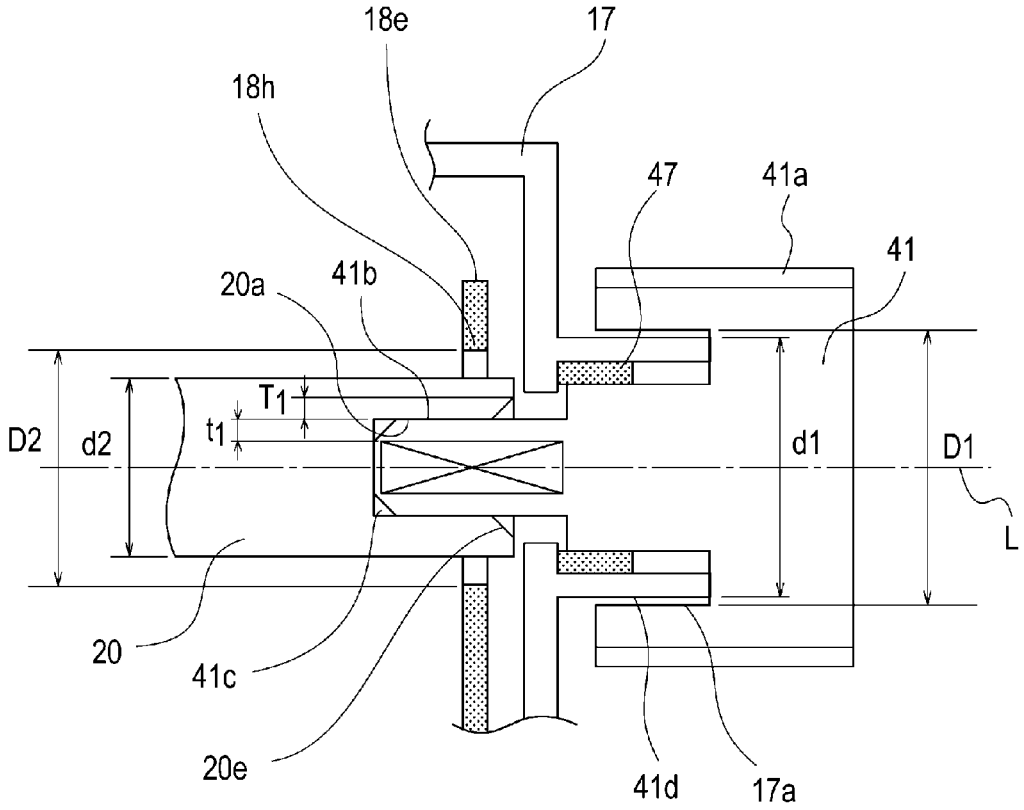

FIG. 7 is a sectional view of the developer accommodating unit at one longitudinal end portion (driving side).

Figure 8:
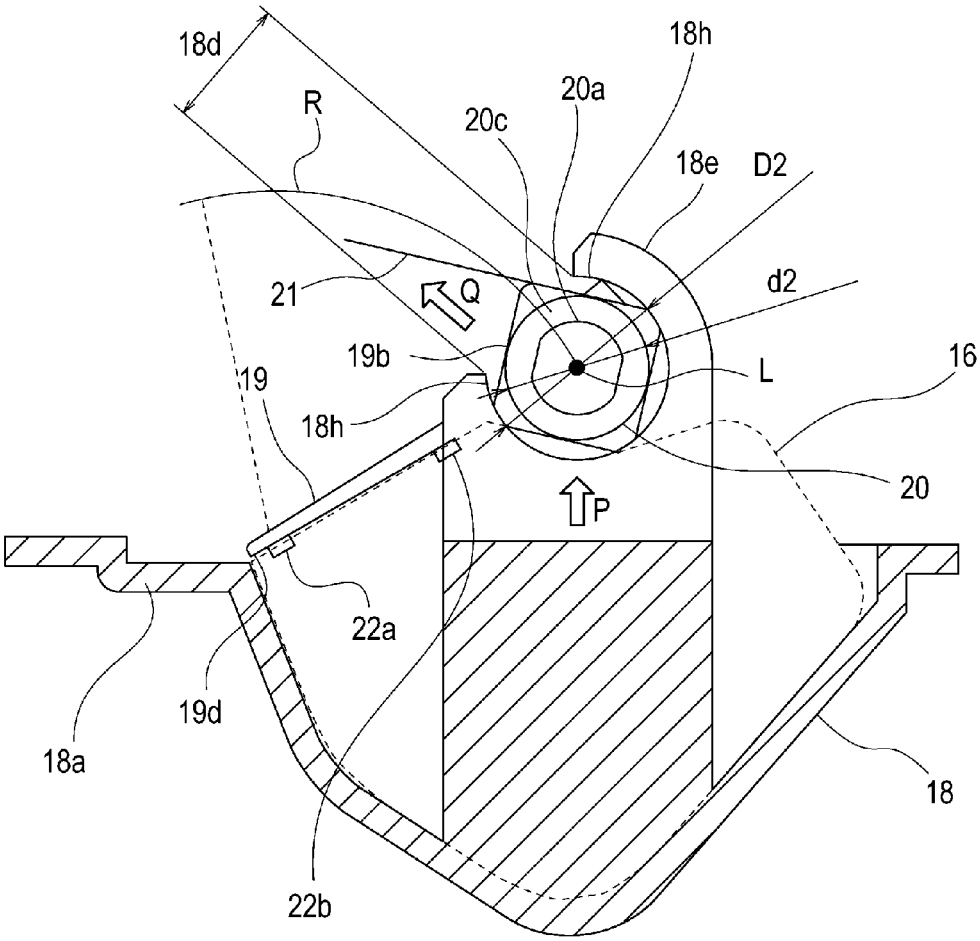

FIG. 8 is a sectional view of the neighborhood of a temporary shaft supporting portion in the embodiment of the present invention.

Figure 9:
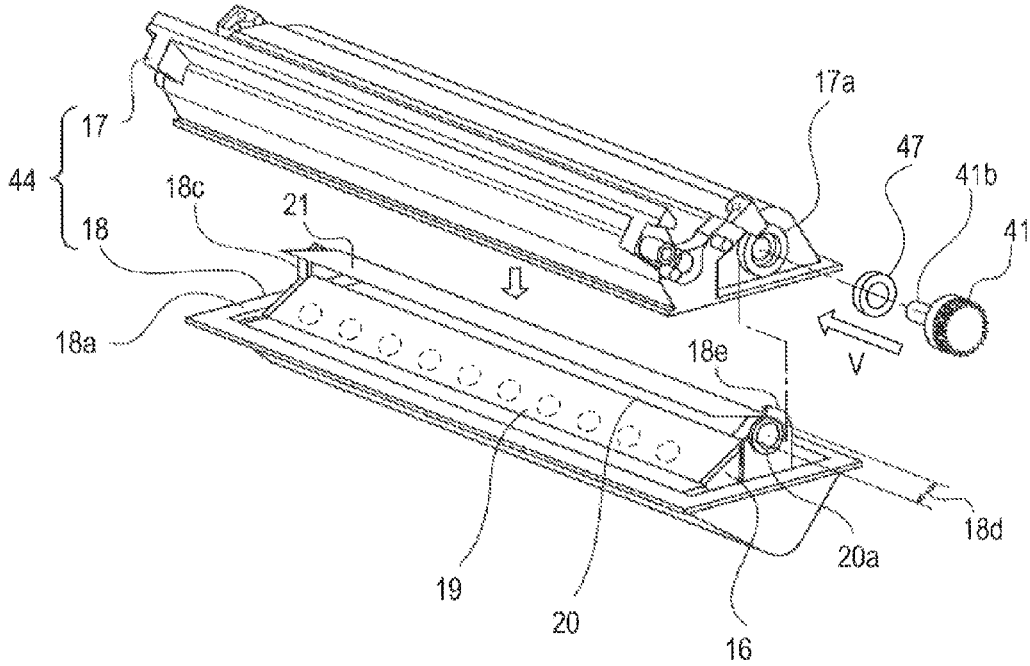

FIG. 9 is a perspective view for illustrating an assembling method of the developer accommodating unit in the embodiment of the present invention.

Figure 10:
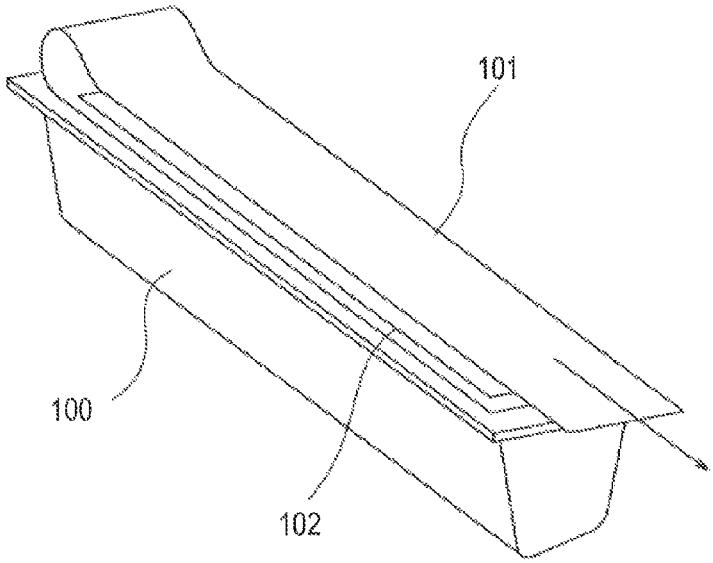
Fig. 10 PRIOR ART

FIG. 10 is a perspective view for illustrating a conventional developer accommodating container.

DESCRIPTION OF THE PREFERRED EMBODIMENTS

In the following description, a developer accommodating container refers to at least a flexibility container and a sealing member for sealing an opening, provided to the sealing member, for permitting discharge of a developer. A developer accommodating unit includes at least the developer accommodating container and a frame for accommodating the developer accommodating container.

First Embodiment

Figure 1:
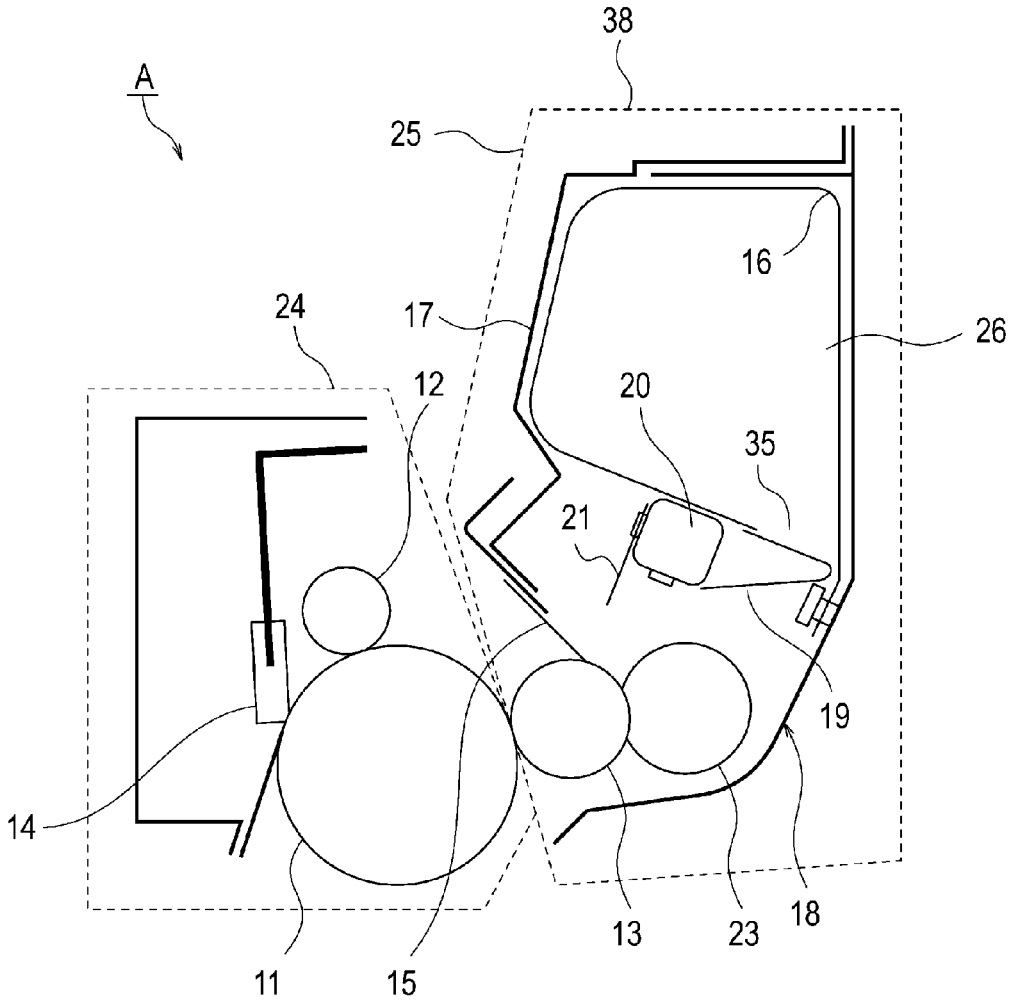
FIG. 1 is a principal sectional view of a process cartridge in an embodiment of the present invention.
Figure 2:
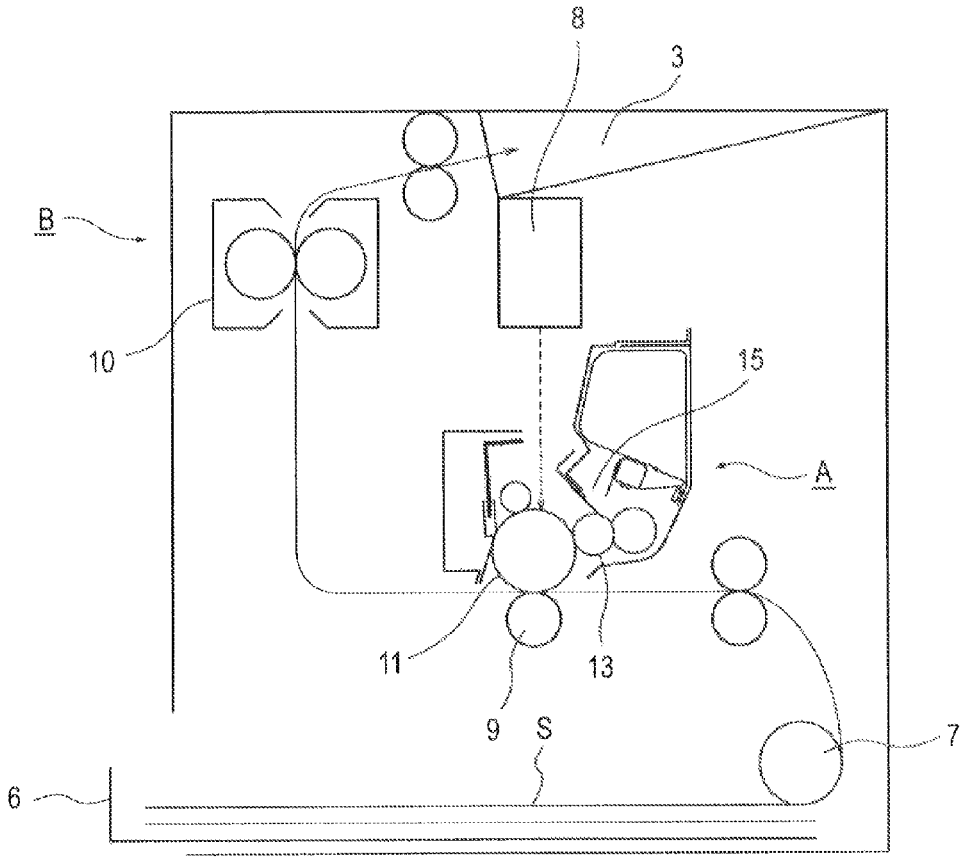
FIG. 2 is a principal sectional view of an image forming apparatus in the embodiment of the present invention.

FIG. 1 is a principal sectional view of a process cartridge including the developer accommodating unit to which the present invention is applicable, and FIG. 2 is a principal sectional view of an electrophotographic image forming apparatus to which the present invention is applicable.

<General Structure of Process Cartridge>

The process cartridge includes an image bearing member, which is an electrophotographic photosensitive member, and process means acting on the image bearing member and is detachably mountable to the image forming apparatus. Examples of the process means include a charging means for electrically charging a surface of the image bearing member, a developing device for forming an image on the image bearing member, and a cleaning means for removing a developer (toner, carrier, etc.) remaining on the image bearing member surface.

The process cartridge A in this embodiment includes, as shown in FIG. 1, includes a photosensitive drum 11 as the image bearing member and includes, at a periphery of the photosensitive drum 11, a charging roller 12 as the charging means and a cleaner unit 24 including an elastic cleaning blade 14 as the cleaning means. Further, the process cartridge A includes a developer accommodating unit 25 including a first frame 17 and a second frame 18. The process cartridge A is prepared by integrally assembling the cleaner unit 24 and the developer accommodating unit 25, and is constituted so as to be detachably mountable to an image forming apparatus main assembly B as shown in FIG. 2. A developing device 38 includes a developing roller 13 as the developing means, a developing blade 15, a developer supplying roller 23, and a developer accommodating container 26 in which the developer is accommodated. The developing roller 13 and the developing blade 15 are supported by the first frame 17.

<General Structure of Image Forming Apparatus>

The process cartridge A is, as shown in FIG. 2, mounted in the image forming apparatus main assembly B and is used for image formation. In the image formation, a sheet S is fed by a feeding roller 7 from a sheet cassette 6 mounted at a lower portion of the apparatus and in synchronism with this sheet feeding, the photosensitive drum 11 is selectively exposed to light by an exposure device 8 to form a latent image. The developer is supplied to the developing roller 13 (developer carrying member) by the developer supplying roller 23 having a sponge shape and is carried in a thin layer on the surface of the developing roller 13 by the developing blade 15. By applying a developing bias to the developing roller 13, the developer is supplied depending on the latent image and thus the latent image is developed into a developer image. This developer image is transferred onto the fed sheet S under bias voltage application to a transfer roller 9. The sheet S is conveyed to a fixing device 10, in which the image is fixed on the sheet S and then the sheet S is discharged to a discharge portion 3 at an upper portion of the apparatus.

<Structure of Developer Accommodating Unit>

The developer accommodating unit 25 accommodated the developer to be supplied to the developing roller 13 depending on the image formation. The developer accommodating unit 25 in this embodiment includes the developer accommodating container 26 having flexibility in the frame. The developer accommodating unit 25 accommodates the developer in a developer bag 16, and a discharging portion 35 is sealed with a sealing member 19. Then, when used, the sealing member 19 is unsealed by an unsealing member 20, so that the developer is supplied to the developing roller 13.

(Developer Accommodating Container)

Figure 3:
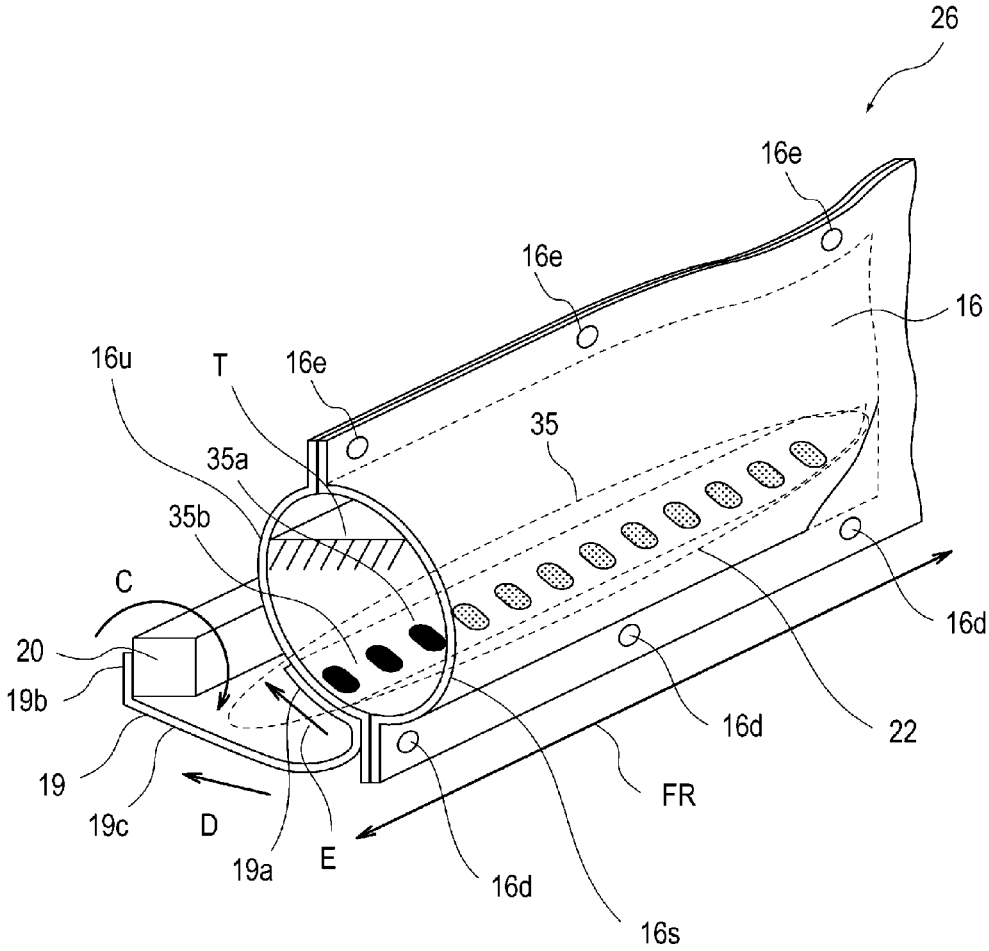
FIG. 3 is a perspective view of a developer accommodating container in the embodiment of the present invention.
Figure 4:
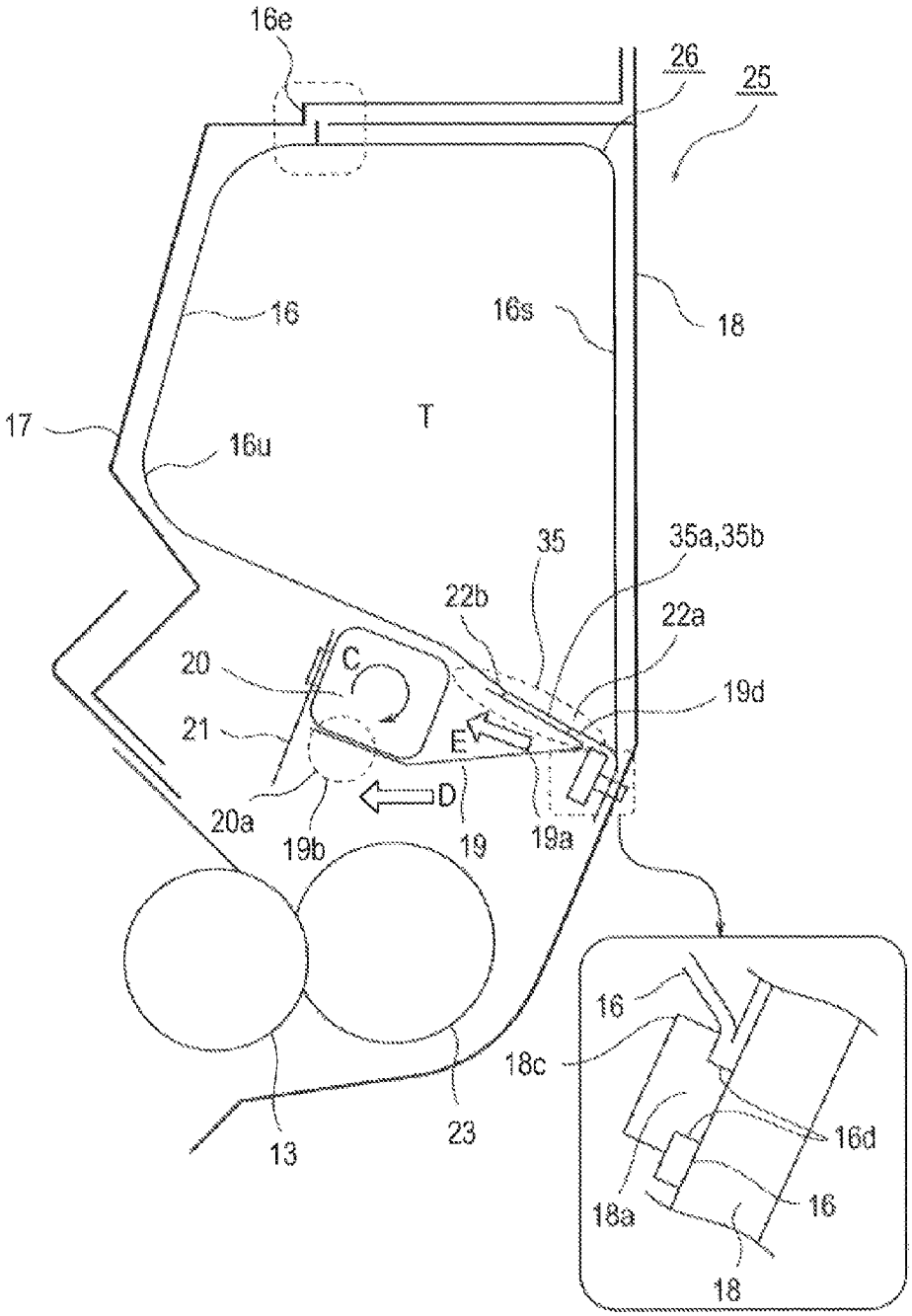
FIG. 4 is a sectional view of a developer accommodating unit in the embodiment of the present invention.

Next, a structure of the developer accommodating container 26 will be described with reference to FIGS. 3 and 4. FIG. 3 is a perspective view of the developer accommodating container 26, as seen from a cross-sectional side, in a state in which the sealing member 19 is attached to the developer accommodating container 26, and FIG. 4 is a sectional vie of the developer accommodating unit 25. The sectional view is illustrated along a plane passing through the unsealing member 20, an opening 35*a* and a portion-to-be-fixed 16*d*. Further, the sectional view is illustrated along a plane perpendicular to a rotation shaft of the unsealing member 20.

As shown in FIG. 3, the developer accommodating container 26 is constituted by a developer T, the developer bag 16 and the sealing member 19. The developer T is powder.

The developer bag 16 of the developer accommodating container 26 is sealed with the sealing member 19 at the plurality of openings 35*a* for permitting the discharge of the developer and includes an unshown filling opening for permitting the filling of the developer T. The filling opening is connected (joined) after the developer T is filled. Thus, the respective openings 35*a* and the filling opening of the developer accommodating container 26 in which the developer is applied is sealed and therefore the accommodated developer is not leaked out to the outside, so that the developer accommodating container 26 can be treated at a single unit. Further, as shown in FIG. 3, the sealing member 19 includes a portion-to-be-engaged 19*b* to be engaged with the unsealing member 20, thus being engageable with the unsealing member 20.

(Developer Bag)

As shown in FIGS. 3 and 4, the developer bag 16 accommodated the developer therein and has a bag-like shape which is deformable, and is provided with the plurality of openings 35*a* at the discharging portion 35 for permitting the discharge of the accommodated developer.

Further, the developer bag 16 includes developer bag fixing portions (portions-to-be-fixed) 16*d* and 16*e* to be fixed to the first frame 17 and the second frame 18.

The developer bag 16 in this embodiment is constituted by bonding a sheet 16*u* which includes the discharging portion 35 and does not have air permeability (hereinafter, this sheet is referred to as a non-permeable sheet) and a sheet 16*s* which has the air permeability without causing the leakage of the developer (hereinafter, this sheet is referred to as a permeable sheet) to each other.

As a material for the permeable sheet 16*s*, a nonwoven fabric or the like formed of polyethylene telephthalate (PET), polyethylene (PE), polypropylene (PP) or the like in a thickness of 0.03-0.15 mm may preferably be used. Further, even when the material for the permeable sheet 16*s* is not the nonwoven fabric, a material having minute holes which is smaller in diameter than the powder such as the developer may also be used.

As a material for the developer bag 16 other than the permeable sheet 16*s*, a material having flexibility so as to improve efficiency during the discharge of the developer may preferably be used. Further, the material for the permeable sheet 16*s* may also have flexibility.

The reason why the air permeability is imparted to the developer bag 16 as described above is that the developer bag 16 can meet states during manufacturing, during transportation until a user uses the cartridge A, and during storage. That is, the reason for the state during the manufacturing is that the developer bag 16 is made deformable and reducible in order to facilitate assembling the developer bag 16 with the frames 17 and 18. Further, the reason for the states during the transportation and during the storage is that the developer bag 16 can meet a change (difference) in air pressure between the inside and outside of the developer bag 16 during the transportation and during the storage of the process cartridge A. The difference in air pressure between the inside and outside of the developer bag 16 is generated in the case where the developer bag 16 is in a lower air-pressure environment during the transportation or the like than during the manufacturing or in the case where the developer bag 16 is stored at a higher temperature than during the manufacturing. For that reason, by expansion of the developer bag 16, there is a possibility that parts contacting the developer bag 16 are deformed or broken. Therefore, there is a need to control the air pressure and the temperature during the transportation and during the storage, so that facilitates for that purpose are required and a cost is increased. However, problems caused due to the difference in air pressure between the inside and outside of the developer bag 16 can be solved by partly imparting the air permeability to the developer bag 16.

As shown in FIG. 3, the developer bag 16 include the developer discharge portion 35 consisting of the plurality of openings 35*a* for permitting the discharge of the developer therein and the connecting portion 35*b* for connecting the plurality of openings 35*a*. Further, the discharge portion 35 is continuously surrounded by a welded bonding portion 22 to be unsealably bonded, so that the developer accommodated in the developer bag 16 is sealed with the sealing member 19.

The bonding portion 22 has a rectangular shape consisting of two lines extending in a long direction (direction FR) and two lines extending in a short direction (direction E) so as to surround the discharge portion 35 and therefore the bonding portion 22 enables the sealing of the discharge portion 35.

Here, of the two lines of the welded bonding portion 22 extending in the long direction (direction FR), a bonding portion which is first unsealed is referred to as a first bonding portion 22*a* and a bonding portion which is unsealed later is referred to as a second bonding portion 22*b*. In this embodiment, as shown in FIG. 4, in the case where the bonding portion 22 is viewed along the surface of the sealing member 19, a bonding portion closer to a fold-back portion 19*d* is the first bonding portion 22*a*. Further, a bonding portion opposing the first bonding portion 22*a* via the opening 35*a* is the second bonding portion 22*b*.

In this embodiment, an unsealing direction is a direction E in FIG. 4. In the case where the unsealing is effected by moving the sealing member 19 in a direction D, of the first bonding portion 22*a* and the second bonding portion 22*b* opposing to each other via the opening 35*a*, the first bonding portion 22*a* is first unsealed (peeled). Thus, a direction directed from the first bonding portion 22*a* to be first unsealed toward the second bonding portion 22*b* is the unsealing direction E.

The plurality of openings 35*a* and the plurality of connecting portions 35*b* are alternately disposed along the direction FR perpendicular to the unsealing direction E. Further, the sealing member 19 is configured to be wound up by rotating the unsealing member 20 but the direction FR is the same direction as an axis (axial line) of the rotation shaft of the unsealing member 20.

By disposing the openings 35*a* as described above, the developer is easily supplied, during the discharge thereof, to the developing roller 13 over the entire longitudinal direction without being localized. Further, the discharge portion 35 where the plurality of openings 35*a* are disposed is long in the developing roller FR and short in the direction E and therefore a distance required for the unsealing is shorter than that when the sealing member 19 is unsealed in the long direction FR, so that a time required for the unsealing can be shortened.

Further, in an attitude during image formation, the openings 35*a* are disposed so as to open downward with respect to the direction of gravitation in order to easily discharge the accommodated developer in the attitude during image formation.

The above-described developer bag 16 is, as shown in FIGS. 3 and 4, fixed inside the first frame 17 and the second frame 18 by two fixing portions 16*d* and 16*e*.

(Sealing Member)

As shown in FIGS. 3 and 4, the sealing member 19 covers the opening 35 of the developer bag 16 before use of the contact to confine the developer in the developer bag 16. The sealing member 19 is wound up by the unsealing member 20, so that the openings 35*a* are exposed. The sealing member 19 is constituted by a sheet-like member including a sealing portion 19*a* for covering (sealing) the discharge portion 35 of the developer bag 16, a portion-to-be-engaged 19*b* to be fixed (engaged) with the unsealing member 20, and a sealing member connecting portion 19*c* which connects the sealing portion 19*a* and the portion-to-be-engaged 19*b*. The sheet member is formed of a laminate material having a sealant layer which exhibits an easy-unsealing property, and a base material therefor is polyethylene telephthalate (PET), polyethylene, polypropylene or the like. A thickness of the sheet member may appropriately be set in a range of 0.03-0.15 mm.

The sealing portion 19*a* refers to a region where the sealing member 19 seals the plurality of openings 35*a* and connecting portions 35*b* of the developer bag 16. By the sealing portion 19*a*, the developer is prevented from being leaked from the inside of the developer bag 16 until before use of the process cartridge A. The sealing member 19 has a free end portion in one end side thereof with respect to the unsealing direction E and at the free end portion, the portion-to-be-engaged 19*b* to be engaged with the unsealing member 20 for winding up the sealing member 19 is provided.

Of the sealing member 19, a portion for connecting the bonding portion 22 and the portion-to-be-engaged 19*b* is the sealing member connecting portion 19*c*. The sealing member connecting portion 19*c* is a portion for transmitting a force so as to pull off the bonding portion 22 by receiving the force from the unsealing member 20.

Further, fixing between the sealing member 19 and the unsealing member 20 is, in this embodiment, made by ultrasonic caulking similarly as in the case of the first fixing portion 16*d*. Other than the ultrasonic caulking, the fixing may also be made by welding, ultrasonic welding, bonding, insertion between the frames, hooking by a hole and a projection, or the like similarly as a means for fixing the first fixing portion 16*d* and the second fixing portion 16*e*.

(Unsealing Member)

The unsealing member 20 pulls off the sealing member 19 from the developer bag 16 by applying a force to the sealing member 19 to move the sealing member 19. The unsealing member 20 has a rectangular shaft shape, and its length is slightly shorter than a distance from one longitudinal inner wall of a developing (device) frame 44 to another longitudinal inner wall of the developing frame 44. Both ends of the unsealing member 20 are rotatably supported by the second frame 18. On one surface of the rectangular shaft of the unsealing member 20, the portion-to-be-engaged 19*c* of the sealing member 19 is engaged and fixed. Then, the unsealing member 20 is rotated to wind up the sealing member 19, thus pulling off the sealing member 19 from the developer bag 16.

<Drive Transmission Constitution>

Figure 5:
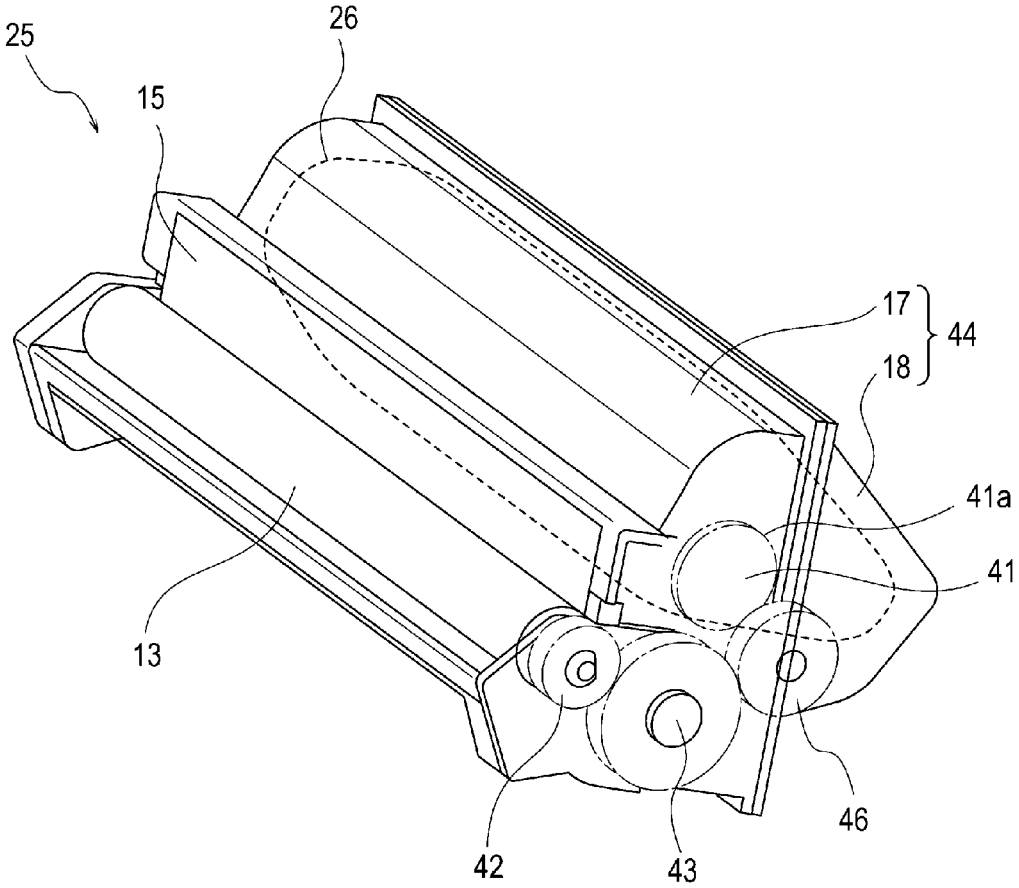
FIG. 5 is a perspective view of an outer appearance of the developer accommodating unit in the embodiment of the present invention.

Next, a drive transmission constitution of the developer accommodating unit 25 will be described with reference to FIGS. 5 and 6. FIG. 5 is a perspective view of an outer appearance of the developer accommodating unit 25, (a) of FIG. 6 is a perspective sectional view of the developer accommodating unit 25 at one longitudinal end portion (driving side), and (b) of FIG. 6 is a perspective sectional view of the developer accommodating unit 25 at another longitudinal end portion (non-driving side).

The developer accommodating unit 25 accommodates, as shown in FIG. 5, the developer accommodating container 26 in the single developing frame 44 constituted by integrally connecting the first frame 17, which supports the developing roller 13 and the developing blade 15, with the second frame 18.

The developing roller 13 is rotatably supported by the first frame 17 at its longitudinal ends. A developing gear 42 is mounted integrally to the developing roller 13 at a longitudinal end portion of the developing roller 13. Further, an input gear 43 engageable with an unshown driving force applying portion provided in the apparatus main assembly B is rotatably supported by the first frame 17 at a longitudinal end portion of the first frame 17. The input gear 43 is provided at a position where it is engaged with the developing gear 42. Further, a driving shaft 41 which is a drive transmission member for transmitting a driving force for unsealing the developer accommodating container 26 is provided. The driving shaft 41 is, as shown in (a) of FIG. 6, rotatably and positionally supported, at its portion-to-be-supported 41*d*, by a driving shaft supporting portion 17*a* provided at one longitudinal end portion of the first frame 17.

The driving shaft 41 is provided with a gear portion 41*a*. Further, as shown in FIG. 5, a stepped gear 46 is rotatably mounted to the first frame 17, and with the stepped gear 46, the gear portion 41*a* of the driving shaft 41 and the input gear 43 are engaged. As a result, the driving force of the input gear 43 is transmitted to the driving shaft 41 via the stepped gear 46. Incidentally, in the following description, the longitudinal end portion (side) where the driving shaft 41 is provided is referred to as the driving side and its opposite side is referred to as the non-driving side.

In the driving-side longitudinal end portion of the unsealing member 20, a D-cut hole-like portion-to-be-engaged 20*a* for being engaged with the driving shaft 41 is formed. On the other hand, the driving shaft 41 is provided with a projection-shaped engaging portion 41*b* having a D-cut cross-sectional shape which is the same as the shape of the portion-to-be-engaged 20*a*. The engaging portion 41*b* is engaged with the portion-to-be-engaged 20*a*, so that the driving shaft 41 is locked integrally with the unsealing member 20 and thus the driving shaft 41 and the unsealing member 20 are integrally rotatable.

Further, the driving shaft 41 is rotatably and positionally supported, at its portion-to-be-supported 41*d*, by the driving shaft supporting portion 17*a* of the first frame 17, so that the unsealing member 20 is positioned at a predetermined position of the first frame 17.

Further, between the driving shaft 41 and the driving shaft supporting portion 17*a* for supporting the driving shaft 41, a shaft sealing member 47 (FIG. 7) having elasticity is provided, so that leakage of the developer from the engaging portion of the driving shaft 41 is prevented.

On the other hand, a shaft end portion 20*b* of the unsealing member 20 in the non-driving side is, as shown in (b) of FIG. 6, rotatably supported by being interposed between a shaft end supporting portion 17*b* of the first frame 17 and a shaft end supporting portion 18*c* of the second frame 18. The shaft end supporting portion 18*c* of the second frame 18 has an arcuate cut-away shape which is slightly larger than an outer diameter of the shaft end portion 20*b*, and an arcuate open portion 18*f* is formed in a shape which is slightly narrower than the outer diameter of the shaft end portion 20*b*. On the other hand, the shaft end supporting portion of the first frame 17 has an arcuate U-character groove shape which is slightly larger than the outer diameter of the shaft end portion 20*b*, and its arcuate portion is formed so as to overlap with the arcuate open portion 18*f* of the shaft end supporting portion 18*c* of the second frame 18 as seen from an axial direction of the unsealing member 20.

<Unsealing and Discharging Operation>

Next, the unsealing of the developer accommodating container 26 will be described with reference to FIGS. 3 and 4. When the driving force is inputted from the apparatus main assembly B to the input gear 43, the driving force is transmitted to the driving shaft 41 via the stepped gear 46, so that the rotational force is transmitted to the unsealing member 20 provided integrally with the driving shaft 41 and thus the unsealing member 20 is rotated in a direction indicated by an arrow C in FIG. 4. With this rotation, the unsealing member 20 fixed on the sealing member 19 is pulled in the arrow D direction. Here, the portion-to-be-fixed 16*d* of the developer bag 16 is fixed to the fixing portion 18*a* of the second frame 18 and therefore a force is exerted on the first bonding portion 22*a* in the arrow direction, so that the first bonding portion 22*a* is peeled first. As the rotation of the unsealing member 20 is advanced, the welded portion at longitudinal end portions is peeled and thus the unsealing is advanced in the arrow E direction, so that the openings 35*a* are exposed and the second bonding portion 22*b* is finally peeled to complete the unsealing.

On the unsealing member 20, an urging member 21 for urging the developer bag 16 is provided downstream of the portion-to-be-engaged 19*b* of the sealing member 19 with respect to the rotational direction C. The urging member 21 is a flexibility sheet extending in the longitudinal direction in a length which is slightly shorter than the distance between the both of the inner walls of the developing frame 44. When the unsealing member 20 is rotated, the urging member 21 is rotated while externally urging the developer bag 16. By this operation, the developer T in the developer accommodating container 26 is pushed toward the openings 35*a* and thus is discharged through the openings 35*a*. Further, in this embodiment, the urging member 21 has the function of stirring the developer discharged from the developer accommodating container 26 and also has the function of feeding, toward the developing roller 13, the developer discharged from the developer accommodating container 26.

<Assembling Constitution of Developer Accommodating Container and Unsealing Member with Developing Frame>

Next, a step of assembling the developer accommodating container 26, to which the unsealing member 20 is mounted, with the developing frame 44 will be described. First, the sealing member 19 is bonded and then the developer T is filled in the developer bag 16 where the discharge portion 35 is sealed with the sealing member 19, so that the developer accommodating container 26 is prepared. Then, the unsealing member 20 is engaged with the portion-to-be-engaged 19*b* of the sealing member 19 to integrally assembling the developer bag 16, the sealing member 19 and the unsealing member 20, thus preparing the developer accommodating container 26 shown in FIG. 3.

The developer accommodating container 26 is assembled with the second frame 18 with respect to a radial direction of rotation of the unsealing member 20 (direction directed from a front side to a rear side in (a) of FIG. 6), and then the portion-to-be-fixed 16*d* is mounted to the fixing portion 18*a* of the second frame 18.

(Temporary Shaft Supporting Portion>

After the developer accommodating container 26 is assembled with the second frame 18, the unsealing member 20 is mounted to the second frame 18. At this time, in this embodiment, the unsealing member is mounted by being temporarily supported by a temporary shaft supporting portion 18*e* which is a supporting member provided to the second frame 18.

A structure of the temporary shaft supporting portion 18*e* will be described with reference to FIGS. 7, 8 and 9. FIG. 7 is a sectional view of the developer accommodating container 26 at one longitudinal end portion (driving side), FIG. 8 is a sectional view of the neighborhood of the temporary shaft supporting portion 18*e*, and FIG. 9 is a perspective view showing a step of incorporating the developer accommodating container 26 into the developing frame 44.

As shown in FIG. 8, a driving-side shaft end portion 20*c* of the unsealing member 20 has a circular shape in cross section. On the other hand, at an inner driving-side end portion of the second frame 18, the temporary shaft supporting portion 18*e* having an inner diameter D2 which is slightly larger than an outer diameter d2 of the shaft end portion 20*c* of the unsealing member 20 is provided coaxially with a rotation center axis L of the unsealing member 20. The temporary shaft supporting portion 18*e* is provided with an open portion 18*d* having a width which is slightly smaller than the outer diameter d2 of the shaft end portion 20*c* of the unsealing member 20. The direction of the open portion 18*d* is such that the open portion 18*d* is open along a circumference R with the fold-back portion 19*d* of the sealing member 19 as a center axis (the first bonding portion 22*a* since the bonding portion 22 is folded back substantially at the first bonding portion 22*a* in this embodiment).

After the portion-to-be-fixed 16*d* of the developer bag 16 is mounted to the fixing portion 18*a* of the second frame 18, the unsealing member 20 is engaged with the temporary shaft supporting portion 18*e* through the open portion 18*d*. At that time, when tension is exerted on the sealing member 19, there is a possibility that the sealing member 19 is erroneously peeled from the first bonding portion 22*a*. For that reason, there is a need to provide a length from the first bonding portion 22*a* of the sealing member 19 to the portion-to-be-engaged 19*b* of the sealing member 20 with an allowance to some extent. However, in this embodiment, the open portion 18*d* is configured to be directed in the above-described direction and thus the unsealing member 20 can be engaged with the temporary shaft supporting portion 18*e* along the circumference R, so that the allowance of the length of the sealing member 19 can be minimized.

(Preventing Portion)

Further, the open portion 18*d* is configured to have a width which is slightly smaller than the outer diameter d2 of the shaft end portion 20*c* of the unsealing member 20. As a result, the temporary shaft supporting portion 18*e* is provided with a preventing portion 18*h* for preventing the assembled unsealing member 20 from dropping from the temporary shaft supporting portion 18*e*. When the shaft end portion 20*c* is engaged with the temporary shaft supporting portion 18*e*, the open portion 18*d* is elastically deformed until its width is equal to the outer diameter d2 of the shaft end portion 20*e* and then when the shaft end portion 20*c* is completely engaged, the open portion 18*d* is elastically restored, so that the engagement is completed.

Incidentally, the open portion 18*d* is configured to be elastically deformed by a pressing force when the unsealing member 20 is assembled but not to be elastically deformed by a force to the extent of a repelling force, described below, when the unsealing member 20 is contacted to the developer bag 16.

In this embodiment, when the unsealing member 20 is assembled with the temporary shaft supporting portion 18*e*, the unsealing member 20 is contacted to the developer bag 16 and therefore the unsealing member 20 receives, by the flexibility developer bag 16, a force for pushing back the unsealing member 20 in a direction indicated by an arrow P in FIG. 8. Further, the sealing member 19 is assembled in a state in which it is folded from the first bonding portion 22*a* and therefore a force for restoring the sealing member 19 to an original elongated shape. As a result, the unsealing member 20 receives a force in a direction indicated by an arrow Q in FIG. 8 by the above-described restoring force of the sealing member 19.

However, as described above, the open portion 18*d* is configured to be narrower than the outer diameter of the shaft end portion 20*c*, so that the preventing portion 18*h* for preventing the unsealing member 20 from dropping from the supporting member is formed. For this reason, when the shaft end portion 20*c* of the unsealing member 20 is once completely engaged with the temporary shaft supporting portion 18*e*, even under application of the above-described forces in the arrow P and Q directions, the unsealing member is prevented from dropping due to disengagement.

(Positioning of Unsealing Member)

After the unsealing member 20 is engaged with the temporary shaft supporting portion 18*e* as described above, as shown in FIG. 9, the first frame 17 is welded with the second frame 18, thus being integrally assembled as the developing frame 44. In this way, the developing frame 44 accommodates therein the developer accommodating container 26 and the unsealing member 20.

Thereafter, the driving shaft 41 is inserted together with the shaft sealing member 47 from the longitudinal direction (arrow V direction in FIG. 9) toward the driving shaft supporting portion 17*a*. At this time, the portion-to-be-engaged 20*a* of the unsealing member 20 is, by the constitution of the temporary shaft supporting portion 18*e*, in stand-by inside the developing frame 44 in a range of gap between the outer diameter d2 of the unsealing member 20 and the inner diameter D2 of the temporary shaft supporting portion 18*e* as shown in FIG. 8.

In this embodiment, an end portion of the driving shaft 41 (engagement start-side end portion) has a tapered surface 41*c* as shown in FIG. 7. Further, also an end portion of the portion-to-be-engaged 20*a* of the unsealing member 20 (engagement start-side end portion) has a tapered surface 20*e*. Here, a size (radial length of the tapered surface) t1 of the tapered surface 41*c* of the driving shaft 41 and a size T1 of the tapered surface 20*e* of the portion-to-be-engaged 20*a* are set so that the sum the sizes of both of the tapered surfaces is larger than an engagement gap between the outer diameter d2 of the unsealing member 20 and the inner diameter D2 of the temporary shaft supporting portion 18*e*, i.e., $2\times(T1+t1)>(D2-d2)$.

By employing such a constitution, in a state in which an outer peripheral portion of the shaft end portion 20*c* of the unsealing member 20 is contacted to and supported by an inner peripheral portion of the temporary shaft supporting portion 18*e*, when the engaging portion 41*b* of the driving shaft 41 is gradually inserted into the portion-to-be-engaged 20*a* of the unsealing member 20, the tapered surface 41*c* of the driving shaft 41 is guided by the tapered surface 20*e* of the unsealing member 20. For this reason, the engaging portion 41*b* of the driving shaft 41 is inserted into and engaged with the portion-to-be-engaged 20*a* of the unsealing member 20, and the same time, the portion-to-be-supported 41*d* of the driving shaft 41 is engaged with the driving shaft supporting portion 17*a* of the first frame 17.

Here, in this embodiment, as shown in FIG. 7, the respective diameters are set so that a difference (D2−d2) between the outer diameter d2 of the shaft end portion of the unsealing member 20 and the inner diameter D2 of the temporary shaft supporting portion 18*e* is larger than a difference (D1−d1) between an outer diameter d1 of the portion-to-be-supported 41*d* of the driving shaft 41 and an inner diameter D1 of the driving shaft supporting portion 17*a*. That is, in a state in which the driving shaft 41 is assembled with the first frame 17, the diameters are constituted so that the gap between the unsealing member 20 and the temporary shaft supporting portion 18*e* is larger than the engagement gap between the portion-to-be-supported 41*c* of the driving shaft 41 and the driving shaft supporting portion 17*a*, i.e., (D1−d1)>(D2-d2).

As a result, when the driving shaft 41 is rotatably assembled with the first frame 17, the shaft end portion 20*c* of the unsealing member 20 is spaced from the temporary shaft supporting portion 18*e*. Further, the driving shaft 41 integrated with the unsealing member 20 is positioned by the engagement between the portion-to-be-supported 41*c* of the driving shaft 41 and the driving shaft supporting portion 17*a*.

By providing the temporary shaft supporting portion 18*e* as described above and then by assembling the unsealing member 20 within the frame by using the temporary shaft supporting portion 18*e*, the assembling of the unsealing member 20 becomes easy. Further, it is possible to prevent that the unsealing member 20 is moved inside the developing frame 44 due to impact or the like during assembling or transportation before the driving shaft 41 is incorporated into the unsealing member 20 and thus the engagement of the unsealing member 20 with the driving shaft 41 cannot be effected.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 260187/2011 filed Nov. 29, 2011, which is hereby incorporated by reference.

What is claimed is:

1. A developer accommodating unit for accommodating a developer, said developer accommodating unit comprising:

a flexible developer accommodating container that accommodates the developer and is sealed with a sealing member at its opening for permitting discharge of the developer;

a rotatable unsealing member for removing said sealing member from said opening;

a drive transmission member for transmitting a rotational force to said unsealing member, wherein said drive transmission member is mounted at one of longitudinal end portions of said unsealing member and is rotatably assembled with a frame; and a supporting member for supporting said unsealing member when said unsealing member is assembled, wherein said supporting member includes a preventing portion for preventing said unsealing member from dropping from said supporting member in a state before said drive transmission member is assembled with said frame, and wherein, in a state in which said drive transmission member is assembled with said frame, a gap between said unsealing member and said supporting member is larger than a gap between said drive transmission member and said frame, and said unsealing member is spaced from said supporting member.

2. A developer accommodating unit according to claim 1, wherein said preventing portion prevents said unsealing member from dropping from said sealing member by a repelling force received by said unsealing member when said unsealing member contacts said developer accommodating container.

3. A developer accommodating unit according to claim 1, wherein said unsealing member includes an engaging portion at one of its longitudinal end portions and said drive transmission member includes a portion-to-be-engaged engageable with said engaging portion, wherein each of engagement start end portions of said engaging portion and said portion-to-be-engaged is tapered, and wherein a sum of the tapered engagement start end portions is set so as to be larger than the gap between said unsealing member and said sealing member.

4. A developer accommodating unit according to any one of claim 1, wherein in a state in which said developer accommodating container and said unsealing member are assembled with said frame, said sealing member is folded back between said developer accommodating container and said unsealing member, and said sealing member is provided with an open portion, for permitting assembling of said unsealing member, which is open upward along a circumference with a portion, as a center of the circumference, where said sealing member is folded back.

5. A process cartridge detachably mountable to a main assembly of an image forming apparatus, said process cartridge comprising:

a developer accommodating unit according to claim 1; and an electrophotographic photosensitive member integrally assembled with said developer accommodating unit.

6. An electrophotographic image forming apparatus comprising a process cartridge according to claim 5.

7. A developer accommodating unit for accommodating a developer, said developer accommodating unit comprising:

a developer accommodating container that accommodates the developer and is sealed with a sealing member at its opening for permitting discharge of the developer;

a rotatable unsealing member for removing said sealing member from said opening;

a drive transmission member for transmitting a rotational force to said unsealing member, wherein said drive transmission member is mounted at one of longitudinal end portions of said unsealing member and is rotatably assembly with a frame; and a supporting member for supporting said unsealing member temporarily at the one of longitudinal end portions when said unsealing member is assembled.

* * * * *